United States Patent [19]

Garis

[11] Patent Number: 5,033,619

[45] Date of Patent: Jul. 23, 1991

[54] LIGHT STRING CARRIER

[76] Inventor: Cynthia L. Garis, 462 Jill Dr., Nazareth, Pa. 18064

[21] Appl. No.: 537,326

[22] Filed: Jun. 13, 1990

[51] Int. Cl.[5] ..... B65D 85/42

[52] U.S. Cl. ..... 206/419; 206/388; 206/420; 206/495

[58] Field of Search ..... 206/419, 420, 422, 329, 206/493, 495, 45.14, 806, 388; 362/249

[56] References Cited

U.S. PATENT DOCUMENTS

| | | | |
|---|---|---|---|
| 1,899,666 | 2/1933 | Buschman | 206/45.14 |
| 2,872,032 | 2/1959 | West | 206/329 |
| 2,984,347 | 5/1961 | Kalinchuk | 206/419 |
| 3,878,941 | 4/1975 | Kelmer | 206/419 |
| 4,022,323 | 5/1977 | Yamazaki | 206/419 |
| 4,356,919 | 11/1982 | Matney | 206/493 X |
| 4,461,383 | 7/1984 | Groff | 206/45.14 |
| 4,651,873 | 3/1987 | Stolcenberg et al. | 206/806 X |

FOREIGN PATENT DOCUMENTS

| | | | |
|---|---|---|---|
| 2445633 | 4/1976 | Fed. Rep. of Germany | 206/420 |
| 2006304 | 12/1969 | France | 206/419 |

*Primary Examiner*—Bryon P. Gehman

*Attorney, Agent, or Firm*—Eckert, Seamans, Cherin & Mellott

[57] ABSTRACT

A light string carrier includes a lattice for holding a light string wrapped thereabout and a handle integral with the lattice. A carrier cover having two hinged members is provided to overfit the lattice with the handle protruding from the cover. Hinges on the cover members provide for removability of the cover from the lattice.

8 Claims, 2 Drawing Sheets

Fig. 4.
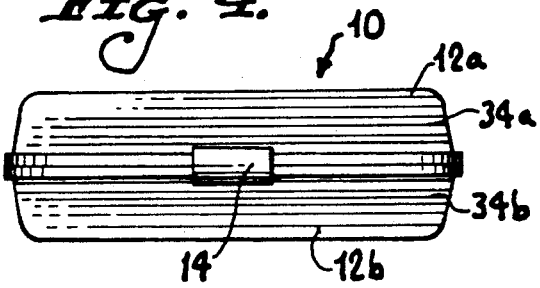
Fig. 5.
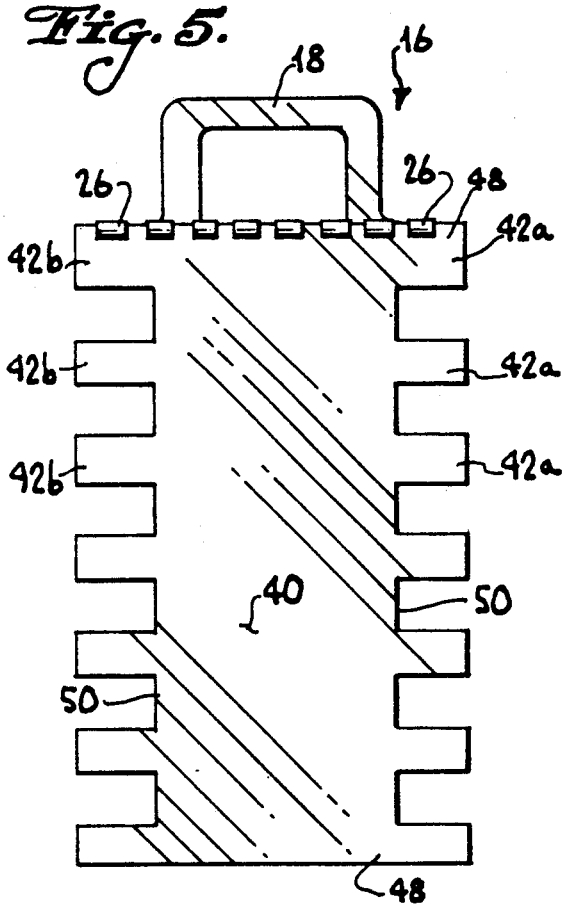
Fig. 3.
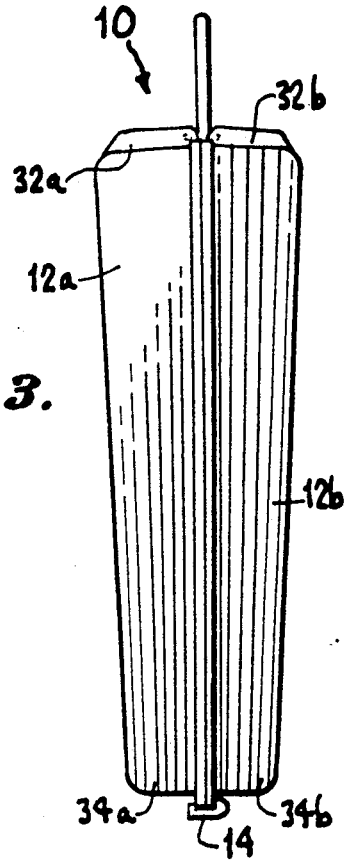
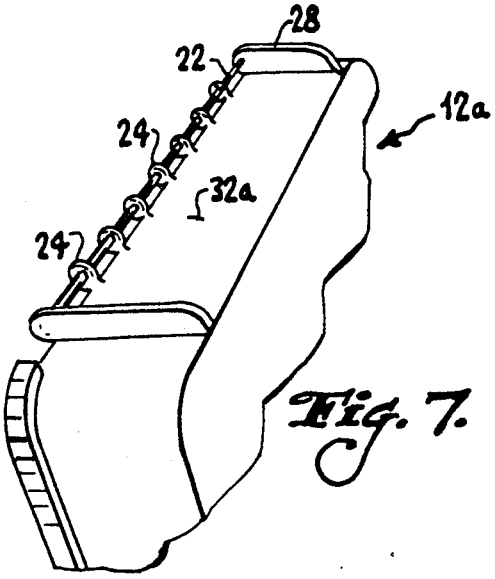
Fig. 7.
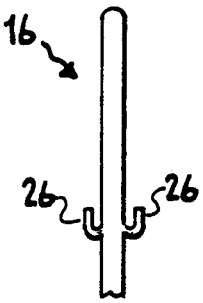
Fig. 6.

LIGHT STRING CARRIER

BACKGROUND OF THE INVENTION

1. Field of the Invention

This invention relates to a carrier for a relatively long cord or string of light fixtures such as those commonly used to decorate a Christmas tree, and more particularly to a carrier having a completely removable cover.

2. Description of the Prior Art

The strings of lights commonly sold for use on Christmas trees vary in length from a few feet to one hundred feet. They are generally sold in relatively flimsy cardboard boxes with a slotted backing sheet around which the lights are wrapped. When the lights are removed from the tree after use, it is very difficult to reuse the slotted backer and to replace the light strings in the original cardboard box. The slotted backing sheet is generally too flimsy to withstand much bending and the sheet often rips across the slots, whereby only a sheet of flimsy backer remains, without the organizational slots. The longer strings of lights are especially difficult to store without the lights becoming tangled in one another. Yet is necessary to store the light strings in such a manner that the light bulbs do not break by being wrapped too tightly against one another and the string does not rub against itself, wear away the coating and expose the electric wiring. It is also necessary to prevent other objects from weighing against the lights and breaking them. It is, therefore, advantageous to have a carrier for light strings which embodies both organizational features and protection from breakage.

SUMMARY OF THE DISCLOSURE

The light string carrier of this invention embodies both organizational features and a protective cover for the lights. A lattice for holding a wrapped light string is provided with a handle and the lattice is contained inside a hinged storage case. The lattice is generally a flat rectangular support with arms extending out the long sides. A handle is centered at the top of the lattice. In a preferred embodiment, the lattice is about twelve inches in length and about nine inches in width. The spaces between the outwardly extending arms of the lattice are each about one inch wide. The arms extend from the base about one and one half inches. This spacing allows more than one loop of cord or light string to be made at each area defined between two arms.

A carrier cover is provided to protect the filled lattice. The carrier cover is generally a hinged box having two equally sized members. There are snap-together hinge means on both cover members and hinge receiving means attached to each side of the lattice. The cover members' hinge means attach to the hinge receiving means on either side of the lattice, allowing the handle to extend out of the closed carrier cover while the cover completely overfits the lattice and the light string wrapped thereupon.

It is, therefore, an object of this invention to provide a light string carrier which both organizes a string of lights and also protects the string and lights.

It is a further object of this invention to provide a light string carrier with a completely removable light string storage lattice, including handle means.

It is yet another object of this invention to provide a light string carrier cover with a snap-together hinge arrangement.

It is still another object of this invention to provide a reusable light string carrier with a sturdy lattice on which the light string is wrapped.

It is yet another object of this invention to provide a light string carrier cover which is stackable.

It is another object of this invention to provide a light string carrier which organizes the string of lights in an easily removable manner.

It is yet another object of the invention to provide a storage means for light strings which keeps the lights clean and untangled.

It is a further object of the invention to provide a means of increasing the life of light strings by protecting them from damage and crimping during storage.

These and other objects will be more readily ascertainable to one skilled in the art from a consideration of the following figures, description and exemplary embodiments, with the understanding that the drawings are illustrative only and that changes may be made in the specific construction illustrated and described within the scope of the appended claims.

BRIEF DESCRIPTION OF THE DRAWINGS

FIG. 3 is a side view of the closed carrier cover.

FIG. 4 is a bottom view of the closed carrier cover.

FIG. 5 is a view of the lattice removed from the carrier cover.

FIG. 6 is a partial side view of the lattice illustrating the J-shaped hinge clips.

FIG. 7 is a partial perspective view of the top of a carrier cover member illustrating the rod and stanchions of the hinge means.

DETAILED DESCRIPTION OF THE PREFERRED EMBODIMENT(S)

Figure 1:
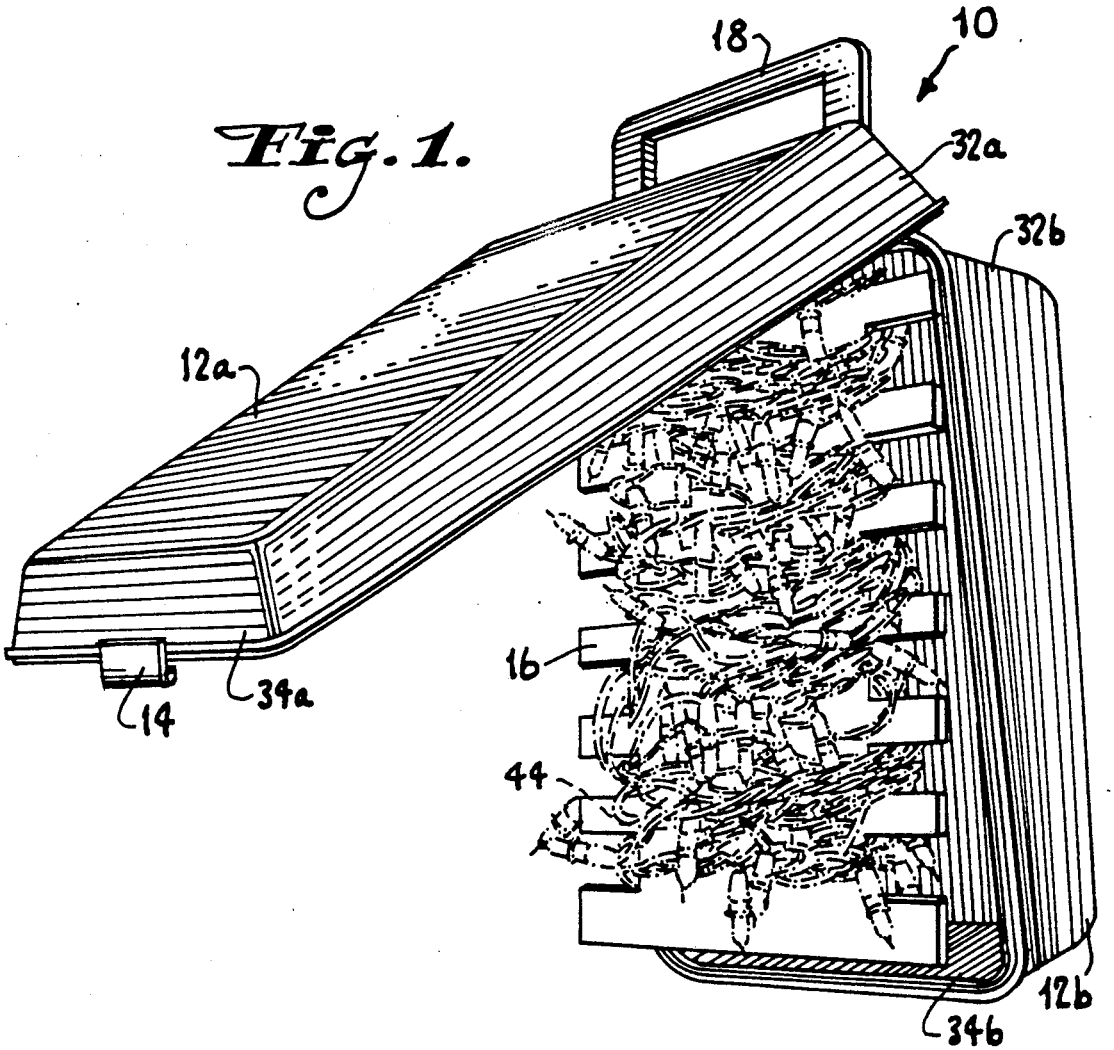
FIG. 1 is a perspective view of the Christmas tree light string carrier according to the invention, partially open and exposing the lattice for the light string with a light string, shown in phantom lines, wrapped thereupon.
Figure 2:
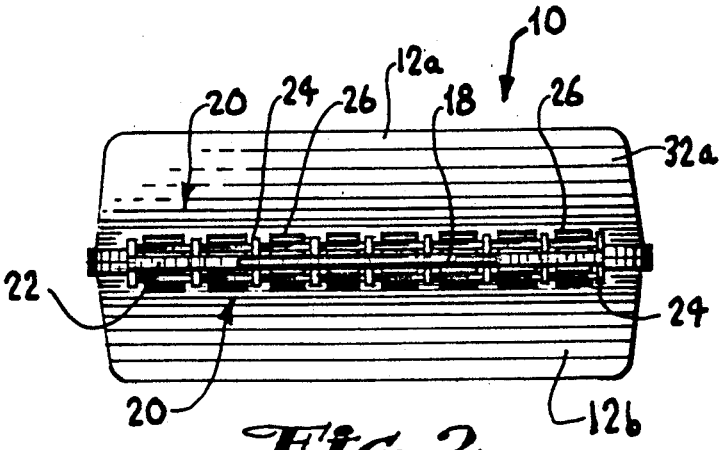
FIG. 2 is a top view of the Christmas tree light string carrier cover in the closed position.

Referring now to the drawings, and more particularly to FIGS. 1, 2, 3 and 4, the assembled and filled light string carrier 10 is illustrated. Carrier 10 includes lattice 16 for holding light string 44 and carrier cover 12, which includes two carrier cover members **12*a* and 12*b*. Although carrier 10 is illustrated throughout as having rounded corners and being tapered in width from top to bottom, a straight-sided box-type configuration is also workable, as would be any general container shape which lends itself readily to containing items of substantial depth. In the embodiment illustrated herein, carrier cover 12 is shown as molded plastic, however, any sturdy, but light-weight, construction material is suitable. For withstanding use over several years time, it is best if lattice 16** is particularly sturdy.

Cover member **12*a* includes latch means 14 at cover bottom end 34*a*. Latch 14 generally hooks over the edge of cover bottom 34*b* (as illustrated in FIGS. 3 and 4). Other latch means are possible, for example, latch 14 may hook over a nipple on cover bottom 34B, or other interlocking latch means may be provided. For security of the contents, it si desirable that latch 14 be fastened (as in FIGS. 3 and 4) when carrier 10 is being carried by handle means 18. It is also possible that bottom ends 34*a*, 34*b* be permanently attached, however use of lattice 16** is facilitated by its easy removal from container cover 12. Removal of lattice 16 from cover members 12a, 12b is best described with reference to FIGS. 5, 6 and 7.

Carrier 10 is particularly useful for organizing and storing Christmas tree light strings. However, it should be understood that any type of string may be stored and carried in carrier 10. For instance, extension cords for indoor or outdoor use, clothesline, or the like may be wrapped around lattice 16 and stored cleanly and untangled inside cover 12. Cover 12 will protect the contents stored therein from dirt and moisture. Storage of items in container 10 will most likely increase the useful life of the article by reducing contamination and damage caused by exposure to moisture and dire and by protection from pressure upon or striking by other articles stored nearby.

In the preferred use, light string 44 is strung around lattice 16 for storage and cover sections 12a, 12b are attached to handle 18 and then fastened together by latch 14. Light string 44 is of any standard size and more than one loop of string is wrapped around base 40 of lattice 16. When assembled, cover 12 defines an interior space sufficient to hold any standard light string, with light bulbs of any standard Christmas tree light size.

As seen in FIG. 5, lattice 16 includes handle 18 and arms 42a, 42b. Arms 42a, 42b are sufficiently deep to provide for easy wrapping of a light string, several loops fitting on the section of body 40 defined between two sets of arms 42a, 42b. When cover 12 is removed from lattice 16, string may be wrapped upon or removed easily and orderly from lattice 16. Preferably, lattice 16 is molded plastic, capable of withstanding repeated use, yet light enough that, when filled, it is still easily carried.

A prime advantage of carrier 10 is that cover 12 is completely removable from lattice 16. Removability if provided by snap-together hinge 20. Hinges 20 (shown in FIG. 2) and its component elements (shown in FIGS. 5, 6 and 7) are identical and positioned on both sides of handle 18 and on both cover member tops 32a, 32b.

Handle 18 is preferably integral with lattice 16 and the hinge receiving means, a set of J-shaped clips 26, are preferably integral with the base of handle 18 and/or top of the lattice 16 (which in the preferred molded plastic version are the same). It is, of course, possible to glue or otherwise attach clips 26 to the lattice or handle. In any case, clips 26 are sufficiently sturdy to withstand repeated outward pressure each time hinge rod 22 is withdrawn for removal of cover 12 from lattice 16.

Rod 22 is held in position on cover tops 32a, 32b by stanchions 24. For additional support, rod supports 28 receive the ends of rod 22 and prevent the rod from being forced in a non-parallel position when it is being pulled from clips 26. Clips 26 are preferably J-shaped and extend outwardly from lattice 16. To attach cover 12 to lattice 16, rod 22 is urged into clips 26 where rod 22 remains closely retained by the spring tension of clips 26.

A light string carrier 10 includes a lattice 16 for holding a light string wrapped thereabout. The carrier has cover 12 comprised of two cover members 12a, 12b. the assembled cover 12 is sized to overfit lattice 16. A hinge assembly 20 removably attaches carrier cover members 12a, 12b to lattice 16. Handle means 18 extends outward from lattice 16 and is preferably integral with lattice 16. Cover members 12a, 12b are joined in a manner allowing handle 18 to extend through the assembled carrier cover 12. Advantageously, lattice 16 comprises a generally flat rectangular base 40 with top end 46, bottom end 48 and sides 50 from which a plurality of parallel arms 42a, 42b extend outwardly. Handle means 18 is generally flat and includes a grasping area and a base integral with lattice top 40.

The lattice 16 includes J-shaped hinge receiving means 26 arrayed on each side of lattice top 40 and extending outward thereform. Hinge receiving means on each carrier cover member top ends 32a, 32b include a rod 2 held in place by stanchions 24 and rod supports 28. In operation, rod 22 is received into the J-shaped clips 26 to close cover members 12a, 12b over lattice 16.

Latch means 14 are provided on bottoms 34a, 34b of cover members 12a, 12b.

Having now illustrated and described my invention, it is not intended that such description limit this invention, but rather that this invention be limited only by reasonable interpretation of the appended claims.

What is claimed is:

1. A light string carrier comprising:

a lattice for holding a light string wrapped thereabout, said lattice having two sides;

a carrier cover having two members, said carrier cover sized to overfit said lattice; and hinge means on each of said members and hinge receiving means on each side of said lattice, each of said hinge means removably interlockable with the hinge receiving means on the respective side of said lattice, whereby said carrier cover is removably, openably attached to said lattice.

2. The light string carrier according to claim 1, further comprising handle means to grasp the carrier and integral with said lattice.

3. The light string carrier according to claim 2, wherein said handle means is generally flat and includes a grasping area and a handle base, said handle base integral with a top of said lattice.

4. The light string carrier according to claim 1, wherein said lattice comprises a generally flat rectangular lattice base having two sides, a top end and a bottom end, said lattice base including a plurality of parallel arms extending outward along said lattice base sides.

5. The light string carrier according to claim 1, wherein said hinge receiving means on each side of said lattice are located at the lattice top, said hinge receiving means being a plurality of generally J-shaped clips extending outwardly from said lattice.

6. The light string carrier according to claim 5, wherein said hinge means on said cover members is a bar having a length equal to the width of said handle base and having a circumference sized to snap-fit into the J-shaped clips of the hinge receiving means on said lattice.

7. The light string carrier according to claim 1, further comprising latch means for removably engaging said members.

8. A light string carrier comprising:

a lattice for holding a light string wrapped thereabout, said lattice having two sides;

handle means integral with said lattice, said handle means providing a graspable structure to enable the carrier to be carried;

a carrier cover having two members, said carrier cover sized to overfit said lattice with said handle means extending outward from said cover; and hinge means on each of said members and hinge receiving means on each side of said lattice, each of said hinge means removably interlockable with the hinge receiving means on the respective side of said lattice, whereby said carrier cover is removably attached to said handle means.

* * * * *